US009518368B2

(12) United States Patent
Nishioka et al.

(10) Patent No.: US 9,518,368 B2
(45) Date of Patent: Dec. 13, 2016

(54) PILE FOUNDATION AND PILE FOUNDATION INSTALLATION METHOD

(71) Applicants: ITOGUMI CONSTRUCTION CO., LTD., Sapporo-shi, Hokkaido (JP); LASCO JAPAN CO., LTD., Miki-shi, Hyogo (JP)

(72) Inventors: Makoto Nishioka, Sapporo (JP); Kazuhiro Nagao, Tomakomai (JP); Manabu Shimatani, Miki (JP); Kazuhiro Shibuya, Sapporo (JP)

(73) Assignees: ITOGUMI CONSTRUCTION CO., LTD., Sapporo-shi, Hokkaido; LASCO JAPANS CO., LTD., Miki-shi, Hyogo (JP)

( * ) Notice: Subject to any disclaimer, the term of this patent is extended or adjusted under 35 U.S.C. 154(b) by 0 days.

(21) Appl. No.: 14/415,852

(22) PCT Filed: Jul. 17, 2013

(86) PCT No.: PCT/JP2013/069440
§ 371 (c)(1),
(2) Date: Jan. 20, 2015

(87) PCT Pub. No.: WO2014/014033
PCT Pub. Date: Jan. 23, 2014

(65) Prior Publication Data

US 2015/0211200 A1 Jul. 30, 2015

(30) Foreign Application Priority Data

Jul. 20, 2012 (JP) ..... 2012-161192

(51) Int. Cl.
*E02D 27/12* (2006.01)
*E02D 5/22* (2006.01)
(Continued)

(52) U.S. Cl.
CPC ..... *E02D 5/223* (2013.01); *E02D 5/54* (2013.01); *E02D 5/80* (2013.01); *E02D 7/00* (2013.01); *E02D 27/12* (2013.01); *E02D 27/14* (2013.01)

(58) Field of Classification Search
CPC ..... E04H 12/22; E02D 5/54; E02D 27/12; E02D 27/14; E02D 31/14
(Continued)

(56) References Cited

U.S. PATENT DOCUMENTS 1,808,633 A * 6/1931 Carver ..... E02D 5/80 52/158
3,751,930 A * 8/1973 Mott ..... E02B 17/02 173/195
(Continued)

FOREIGN PATENT DOCUMENTS

JP 2005299215 A * 10/2005
JP 3916083 B2 2/2007

*Primary Examiner* — Benjamin Fiorello
(74) *Attorney, Agent, or Firm* — Muncy, Geissler, Olds & Lowe, P.C.

(57) ABSTRACT

A pile foundation, on top of which a structural object is placed, supported at the ground surface by a plurality of batter piles, has a pile foundation body comprising a lower plate disposed on the bottom side, an upper plate disposed on the top side, and a support post for supporting the lower plate and the upper plate, separated by a prescribed gap, to be substantially parallel. A plurality of piling holes, through which each of the batter piles pass through in a downward direction in a substantially radial form, are formed in the lower plate and the upper plate.

15 Claims, 4 Drawing Sheets

(51) Int. Cl.

| | |
|---|---|
| ***E02D 5/54*** | (2006.01) |
| ***E02D 27/14*** | (2006.01) |
| ***E02D 5/80*** | (2006.01) |
| ***E02D 7/00*** | (2006.01) |

(58) Field of Classification Search
USPC ..... 405/227
See application file for complete search history.

(56) References Cited

U.S. PATENT DOCUMENTS

| | | | | | |
|---|---|---|---|---|---|
| 5,039,256 | A | | 8/1991 | Gagliano | |
| 5,074,716 | A | * | 12/1991 | Hollowell | E02B 17/027 405/224 |
| 5,243,795 | A | * | 9/1993 | Roberts | E02D 27/00 405/244 |
| 5,873,679 | A | * | 2/1999 | Cusimano | E04B 1/34347 405/229 |
| 7,076,925 | B2 | * | 7/2006 | Gagliano | E02D 27/14 249/34 |
| 8,714,881 | B2 | * | 5/2014 | Gagliano | E02D 5/22 405/227 |
| 2009/0003938 | A1 | * | 1/2009 | Nishimori | E04H 12/223 405/232 |
| 2014/0174003 | A1 | * | 6/2014 | Despotellis | E02D 27/42 52/169.13 |

* cited by examiner

PILE FOUNDATION AND PILE FOUNDATION INSTALLATION METHOD

CROSS REFERENCE TO RELATED APPLICATIONS

This application is a national stage of International Application No.: PCT/JP2013/069440, which was filed on Jul. 17, 2013, and which claims priority to JP 2012-161192 which was filed on Jul. 20, 2012, and which are both herein incorporated by reference.

TECHNICAL FIELD

The present invention relates to a pile foundation for placing a structural object, and particularly, to a pile foundation and a pile foundation installation method suitable for a soft ground.

BACKGROUND ART

Conventionally, a structural object, such as a solar panel and a house, is placed on a foundation installed on the ground surface in order to be always level with the ground. However, the structural object or the like and the foundation may be sedimented or tilted due to their weights when the ground for installing the structural object or the like is a soft ground, such as a wetland and a peatland.

Consequently, proposed is an invention related to a pile foundation that prevents sedimentation or tilt of a structural object or a foundation on a soft ground by fixing the foundation to the ground surface by driving a plurality of driving piles.

For example, the specification of U.S. Pat. No. 5,039,256 proposes a pile foundation including a cylindrical body filled with concrete or cement and including a plurality of driving piles penetrating through the cylindrical body (Patent Literature 1). According to Patent Literature 1, the pile foundation can be carried and reused as a foundation of another structural object after removal of the structural object or the like.

CITATION LIST

Patent Literature

Patent Literature 1: U.S. Pat. No. 5,039,256

SUMMARY OF INVENTION

Technical Problem

However, concrete is used as a material of the pile foundation in the invention described in Patent Literature 1. Therefore, in a cold region where the ambient temperature becomes below 0 degrees Celsius, the moisture contained in the concrete may be frozen, and the moisture may expand. The concrete may be cracked or ruptured, and this so-called frost damage may occur. Furthermore, the weight of concrete is large, and the transportation cost is high. The transportation work and the construction work become heavy labor and burdensome. Furthermore, much time is required from filling to solidification of concrete, and the manufacturing efficiency is low. The pile foundation is not suitable for mass production, and it is difficult to reduce the manufacturing cost. Therefore, an improvement is highly demanded.

On the other hand, when a light, inexpensive steel material or the like is used to manufacture the pile foundation without using the concrete material, the thermal conductivity is high, and the ambient temperature is easily transmitted to the ground through the steel material. Therefore, for example, when the ambient temperature is below 0° C. degrees, the cold air is transmitted to the ground. The moisture in the ground is frozen, and ice layers are formed, causing the soil to rise. This so-called frost heaving phenomenon occurs. The frost heaving phenomenon causes a problem of pushing up or tilting the pile foundation, thereby tilting and damaging a structural object placed on the pile foundation.

The present invention has been made to solve the problems and the like, and an object of the present invention is to provide a pile foundation and a pile foundation installation method that can facilitate and reduce the cost of manufacturing and transportation of structural members as well as construction work at the site, thereby enabling mass production and various cost reductions and enabling to effectively take countermeasures for frost damage and frost heaving.

Solution to Problem

The present invention provides a pile foundation supported on a ground surface by a plurality of driving piles, for placing a structural object on top, the pile foundation including a pile foundation body including: a lower plate disposed on a bottom side; an upper plate disposed on a top side; and a support post that supports the lower plate and the upper plate substantially parallel at a predetermined interval, wherein the lower plate and the upper plate are provided with a plurality of pile holes through which the driving piles penetrate downward in a substantially radial pattern.

In an aspect of the present invention, the pile foundation body may include a thermally insulated pyramid-shaped frost heaving prevention pyramid on a bottom surface of the lower plate, an apex of the frost heaving prevention pyramid facing downward.

In an aspect of the present invention, the frost heaving prevention pyramid may be formed in a polygonal pyramid shape, and the pile hole may be formed on each side surface of the frost heaving prevention pyramid.

In an aspect of the present invention, the pile foundation body may include a sedimentation suppression plate formed with a greater dimension to the outside than the lower plate, the sedimentation suppression plate provided on the lower plate.

In an aspect of the present invention, a plurality of the support posts of the pile foundation body may support outer edges between the upper plate and the lower plate.

In an aspect of the present invention, the support post of the pile foundation body may be formed in a rectangular solid shape and disposed at a center, and four angle steels of a same type may be used for each of the lower plate and the upper plate to surround and fix four upper side surfaces and four lower side surfaces of the rectangular-solid support post to form a substantially rectangular frame shape.

The present invention provides a pile foundation installation construction method of inserting the plurality of driving piles into the pile holes from the upper plate to the lower plate in the pile foundation body to drive the plurality of driving piles into a ground in a substantially radial pattern to install the pile foundation.

Advantageous Effects of Invention

According to the present invention, the manufacturing and transportation of a structural member as well as construction work at the site can be facilitated and inexpensive, thereby enabling mass production and various cost reductions and enabling to effectively take countermeasures for frost damage and frost heaving.

DESCRIPTION OF EMBODIMENTS

Figure 1:
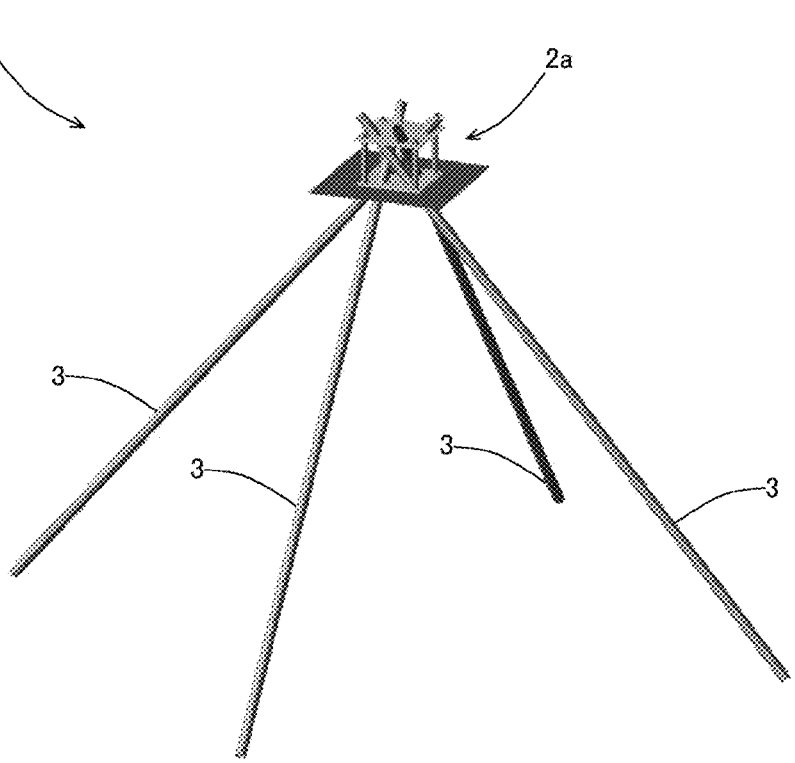
FIG. 1 is a perspective view showing a first embodiment of a pile foundation according to the present invention.

Hereinafter, a first embodiment of a pile foundation and a pile foundation installation construction method according to the present invention will be described with reference to the drawings. As shown in FIGS. 1 to 4, a pile foundation 1*a* according to the present first embodiment mainly includes: a pile foundation body 2*a* installed on a ground surface F; and a plurality of driving piles 3 driven into the ground to support the pile foundation body 2*a*. Hereinafter, each component will be described in detail.

The pile foundation body 2*a* is supported on the ground surface F, such as a soft ground, to enable placing a structural object O on top. As shown in FIGS. 1 to 4, the pile foundation body 2*a* of the present first embodiment includes: a lower plate 21*a* disposed on the bottom side; an upper plate 22*a* disposed on the top side; a plurality of support posts 23*a* that support the lower plate 21*a* and the upper plate 22*a* substantially parallel at a predetermined interval; a frost heaving prevention pyramid 4 arranged on the bottom surface of the lower plate 21*a*; and a sedimentation suppression plate 5 formed to be larger than the lower plate 21*a*.

The lower plate 21*a* is disposed on the bottom side of the pile foundation body 2*a* and formed in a rectangular shape. In the present first embodiment, the lower plate 21*a* is formed by a substantially square-shaped plate material. The lower plate 21*a* includes a plurality of pile holes 24 formed in an elliptical shape in order to insert the plurality of driving piles 3 in a substantially radial pattern.

The upper plate 22*a* is disposed on the top side of the pile foundation body 2*a*, substantially parallel to the lower plate 21*a*, and is formed in a rectangular shape. In the present first embodiment, the upper plate 22*a* is formed by a substantially square-shaped plate material just like the lower plate 21*a*. A plurality of pile holes 24 are formed in an elliptical shape on the upper plate 22*a* in order to insert the plurality of driving piles 3 in a substantially radial pattern. The positions of the pile holes 24 of the lower plate 21*a* and the pile holes 24 of the upper plate 22*a* in the vertical direction are shifted to adjust the driving angles of the driving piles 3, and the driving piles 3 penetrate in a radial pattern. Common components can be used for the lower plate 21*a* and the upper plate 22*a*, and the production cost can be reduced by reducing the types of components constituting the pile foundation body 2*a*. In the present first embodiment, bolts for fixing the structural object O placed at the upper center position of the upper plate 22*a* are attached.

The shape of the lower plate 21*a* and the upper plate 22*a* is not limited to the rectangular shape, and one of a triangular shape, a polygonal shape with five or more sides, a circular shape, and the like may be appropriately selected. The material used for the lower plate 21*a* and the upper plate 22*a* is not particularly limited, and it is desirable to appropriately select a material, such as a hot-dip galvanized steel material, a stainless steel material, and a reinforced plastic material, with rigidity for supporting the structural object O and with appropriate corrosion resistance to oxidization, ultraviolet rays, and the like, because the material is to be exposed to the outside for a long time.

Figure 2:
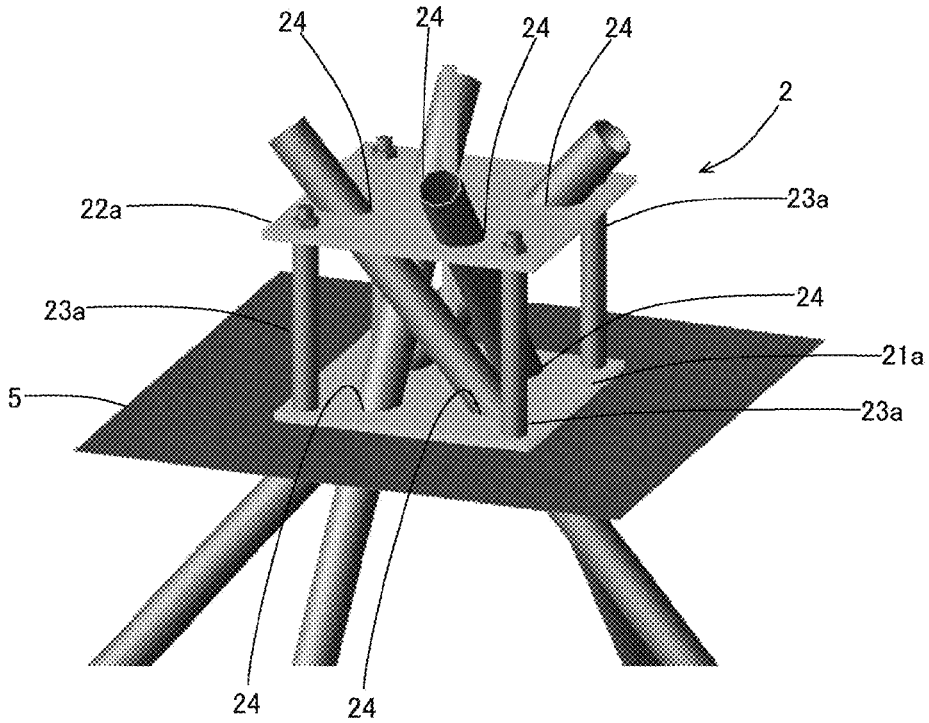
FIG. 2 is an enlarged perspective view showing a pile foundation body according to the present first embodiment.

The support posts 23*a* support the lower plate 21*a* and the upper plate 22*a* substantially parallel at a predetermined interval. As shown in FIGS. 1 and 2, the support posts 23*a* according to the present first embodiment are four substantially columnar bars fixed by bolts at four corners of each of the lower plate 21*a* and the upper plate 22*a*, the four corners being outer edges of the lower plate 21*a* and the upper plate 22*a*.

The shape of the support posts 23*a* is not limited to the substantially columnar shape, and one of a cylindrical shape, a prismatic shape, a square-tube shape, and the like is appropriately selected. Like the lower plate 21*a* and the like, the material used for the support posts 23*a* is appropriately selected from materials with rigidity and corrosion resistance, such as a hot-dip galvanized steel material and a stainless steel material.

Figure 3:
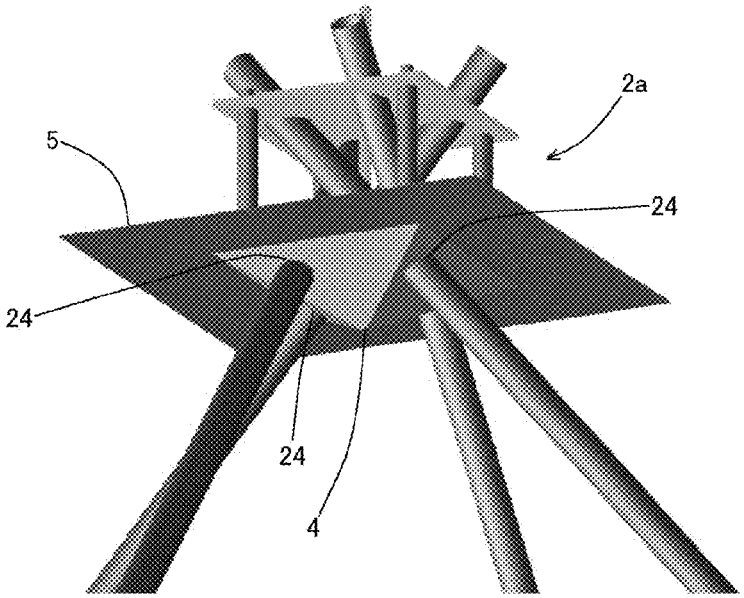
FIG. 3 is an enlarged perspective view showing a frost heaving prevention pyramid according to the present first embodiment.
Figure 4:
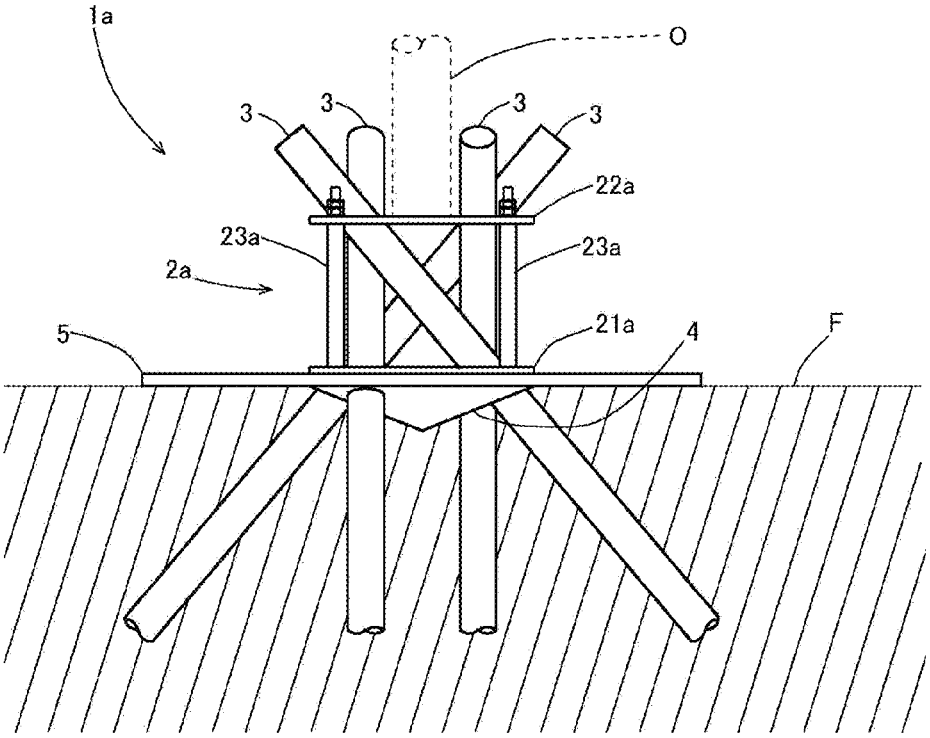
FIG. 4 is a side view showing a state in which the pile foundation of the present first embodiment is installed on the ground.

Next, the frost heaving prevention pyramid 4 will be described. The frost heaving prevention pyramid 4 is made of a thermally insulated material and is arranged between the ground surface F and the lower plate 21*a* as shown in FIGS. 3 and 4 to prevent cold air transmitted from the outside from being transmitted to the ground surface F and to the ground through the lower plate 21*a*. Examples of the thermally insulated material include, but not limited to, chemical synthetic resin, such as plastic and synthetic rubber, natural rubber, ceramics, and FRP. Although the shape of the frost heaving prevention pyramid 4 is not particularly limited, the shape is a pyramid shape in the present first embodiment. The frost heaving prevention pyramid 4 is arranged on the bottom surface of the lower plate, with the apex facing downward. This is intended to install and insert the apex of the frost heaving prevention pyramid 4 into the ground surface F as shown in FIG. 4 to increase the installation surface with respect to the ground surface F for stable installation, even if there is some roughness on the ground surface F. Therefore, there is an advantage that leveling of the installation location is not required.

The frost heaving prevention pyramid 4 according to the present first embodiment is formed into a substantially quadrangular pyramid by a plastic material as shown in FIGS. 3 and 4 and is fixed to the bottom surface of the lower plate 21*a* by bonding, bolting, or the like through a sedimentation suppression plate 5 described later. Each side surface of the frost heaving prevention pyramid 4 includes four pile holes 24 to communicate with the pile holes 24 arranged on the lower plate 21*a* to insert the driving piles 3.

The shape of the frost heaving prevention pyramid 4 is not limited to the substantially quadrangular pyramid, and the shape may be, for example, a triangular pyramid shape, a polygonal pyramid shape with five or more sides, or a conic shape. Although the frost heaving prevention pyramid 4 according to the present first embodiment is formed separately from the lower plate 21*a*, the frost heaving prevention pyramid 4 may be formed integrally with the lower plate 21*a*.

The sedimentation suppression plate 5 is a plate material largely widened outside with respect to the lower plate 21*a* and is arranged on the lower plate 21*a*, thereby increasing the installation area with respect to the ground surface F to function as a floating body and increasing the effect of suppressing the sedimentation of the pile foundation 1*a*. Although the sedimentation suppression effect increases with an increase in the size of the sedimentation suppression plate 5, the level of the strength of the ground, the strength of the sedimentation suppression plate 5, the cost, and the like are taken into account to determine the size. The sedimentation suppression plate 5 according to the present first embodiment is placed between the lower plate 21*a* and the frost heaving prevention pyramid 4 as shown in FIG. 4.

Although the sedimentation suppression plate 5 according to the present first embodiment is formed separately from the lower plate 21*a* or the frost heaving prevention pyramid 4, the arrangement is not limited to this. The sedimentation suppression plate 5 may be formed integrally with one or both of the lower plate 21*a* and the frost heaving prevention pyramid 4.

Next, the driving piles 3 will be described. The driving piles 3 have a columnar shape, a cylindrical shape, a prismatic shape, a square-tube shape, or the like and are made of elongated bars with a predetermined length. The driving piles 3 are inserted to the pile holes 24 arranged on the pile foundation body 2*a* and driven into the ground to support the pile foundation body 2*a* on the ground surface F. The plurality of driving piles 3 according to the present first embodiment include four driving piles 3 as shown in FIGS. 1 and 2.

The shape, the length, the number, and the like of the driving piles 3 are not limited to the four cylinders illustrated in the present first embodiment, but are appropriately selected according to the shape and the size of the pile foundation body 2*a*, the shape and the weight of the structural object O to be mounted, the softness level and the strength of the ground for installation, and the like.

Next, action of each component in the pile foundation 1*a* of the present first embodiment will be described along with the pile foundation installation method according to the present first embodiment.

First, although the pile foundation body 2*a* according to the present first embodiment may be assembled in a factory, the pile foundation body 2*a* can be easily assembled by bolts and nuts. Therefore, the constituent members can be transported to a pile foundation construction site and assembled at the site. The transportation space of the constituent members is small, and the constituent members can be easily managed. Therefore, the manufacturing cost, the transportation cost, and the management cost can be reduced.

Next, the assembled pile foundation body 2*a* is placed on the ground surface F, with the frost heaving prevention pyramid 4 facing downward as shown in FIG. 4. In this case, the apex of the frost heaving prevention pyramid 4 can be installed and inserted into the ground surface F to increase the installation area with respect to the ground surface F for stable installation, even if there is some roughness on the ground surface F. Therefore, leveling of the ground surface F to form a plane surface is not required, and this reduces the construction term and the cost.

Next, the driving piles 3 are inserted into the pile holes 24 from the upper plate 22*a* to the lower plate 21*a* and to the frost heaving prevention pyramid 4, and the driving piles 3 are driven into the ground in a substantially radial pattern. Although it is desirable to drive the driving piles 3 into the hard ground below the soft ground if the ground is a soft ground, the sedimentation suppression plate 5 suppresses sedimentation and tilt of the pile foundation 1*a* even if the driving piles 3 cannot be driven into the ground with sufficient strength. Specifically, the sedimentation suppression plate 5 resists the sedimentation because the installation area with respect to the ground surface F and the underground is wide, and large buoyance is generated in a soft ground close to liquid. Therefore, the resistance to the sedimentation and the buoyance of the sedimentation suppression plate 5 can suppress the sedimentation of the entire pile foundation 1*a* and the structural object O placed on the pile foundation 1*a*.

The sedimentation suppression and the buoyance of the sedimentation suppression plate 5 can be appropriately adjusted by changing the size of the sedimentation suppression plate 5. Therefore, when the load on the plurality of pile foundations 1*a* varies due to the weight balance according to the parts supporting the structural object O or due to wind pressure on the structural object or when the softness level of the ground varies due to the installation location, the size of the sedimentation suppression plate 5 can be appropriately adjusted to control the amount of sedimentation and the sedimentation speed to suppress the tilt of the mounted structural object O.

Since the frost heaving prevention pyramid 4 is made of a thermally insulated material, the heat of the air is not easily transmitted to the soil, and the effect of frost heaving in a winter term in a cold region, such as Hokkaido, can be suppressed.

Since the pile foundation body 2*a* according to the present first embodiment is formed by a material with corrosion resistance, adverse effects caused by frost damage or rust can be prevented.

Furthermore, after the installation of the pile foundation 1*a* of the present first embodiment, the driving piles 3 can be pulled out from the ground to move or reuse the pile foundation body 2*a*. The pile holes 24 in the frost heaving prevention pyramid 4 are formed so that the driving piles 3 penetrate through the side surfaces. Therefore, when the driving piles 3 are pulled out, the driving piles 3 can be easily pulled out without being caught on the side surfaces of the frost heaving prevention pyramid 4.

The following effects can be obtained according to the pile foundation 1*a* and the pile foundation installation method of the present first embodiment.

1. The number of components is small, and an expensive mold is not necessary. Therefore, manufacturing is easy, and the manufacturing cost can be reduced.
2. The pile foundation body 2*a* can be assembled at the installation site. Therefore, the transportation space can be small, and the transportation cost and the installation cost can be reduced.
3. Problems of frost damage and frost heaving when the pile foundation 1*a* is installed in a cold region can be suppressed, and long-term stable use is possible.
4. The pile foundation 1*a* can be easily installed on a soft ground or on a land without leveling of ground, and the structural object O, such as a solar power system, can be installed.

5. Sedimentation caused by the weight of the structural object O can be effectively suppressed.

6. Work of pulling out the driving piles 3 after the installation is easy, and the pile foundation 1*a* can be easily exchanged or reused.

Next, a second embodiment of the pile foundation according to the present invention will be described with reference to the drawings. In a pile foundation 1*b* of the present second embodiment, the same or corresponding components as those of the first embodiment are designated with the same reference signs, and the description will not be described again.

Figure 5:
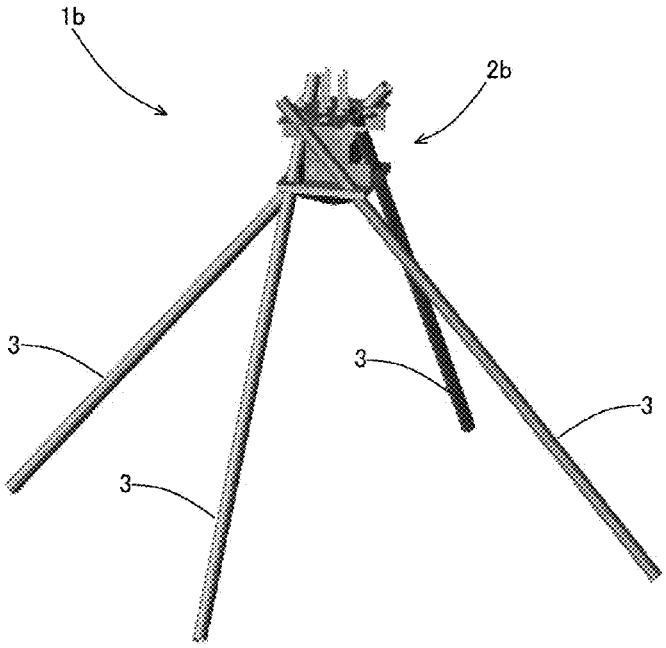
FIG. 5 is a perspective view showing a second embodiment of the pile foundation according to the present invention.
Figure 6:
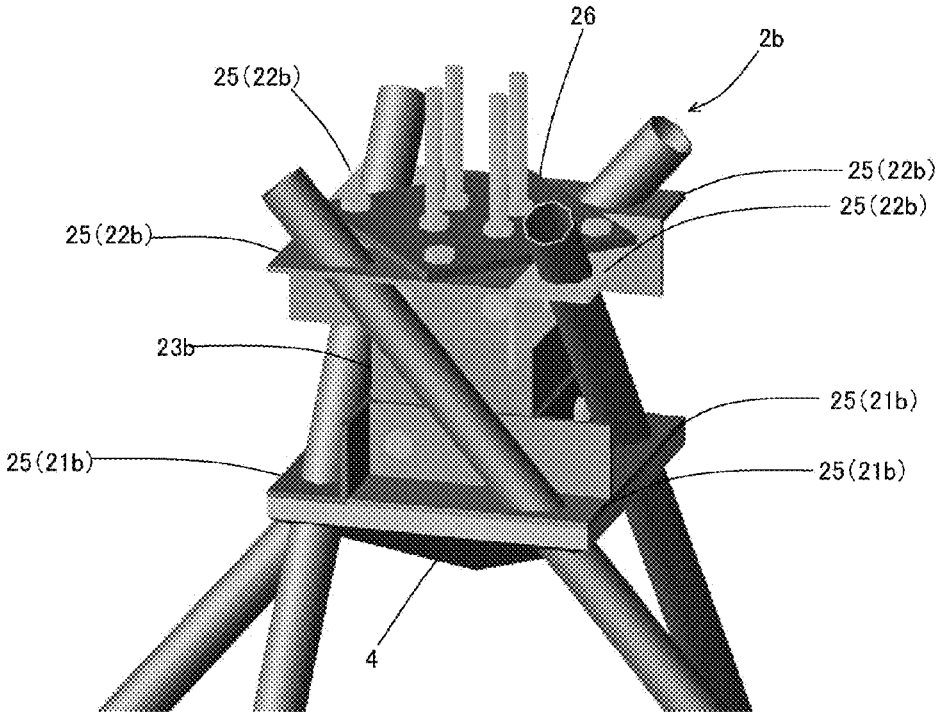
FIG. 6 is an enlarged perspective view showing a pile foundation body according to the present second embodiment.
Figure 7:
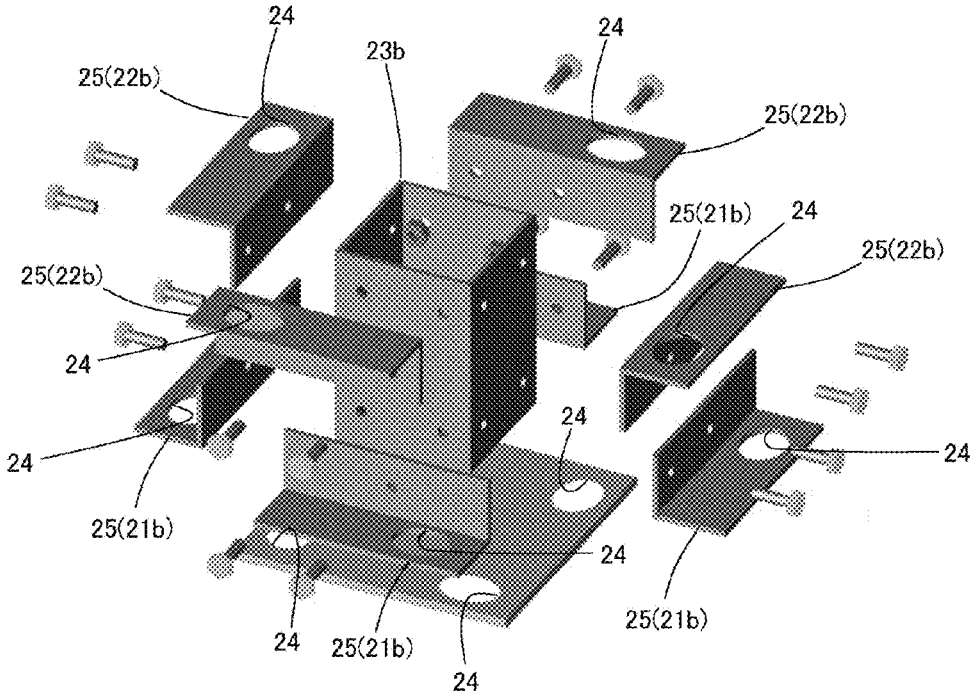
FIG. 7 is an assembly diagram showing a pile foundation body according to the present second embodiment.

As shown in FIGS. 5 to 7, the pile foundation 1*b* of the present second embodiment includes: a pile foundation body 2*b* installed on the ground surface F; and the plurality of driving piles 3 driven into the ground to support the pile foundation body 2*b*. The pile foundation body 2*b* according to the present second embodiment includes: a lower plate 21*b* disposed on the bottom side; an upper plate 22*b* disposed on the top side; a support post 23*b* disposed at the center to support the lower plate 21*b* and the upper plate 22*b* substantially parallel at a predetermined interval; and the frost heaving prevention pyramid 4 arranged on the bottom surface of the lower plate 21*b*.

As shown in FIGS. 5 to 7, the support post 23*b* is formed in a rectangular-solid shape and disposed substantially at the center of the pile foundation body 2*b*. The support post 23*b* according to the present second embodiment is formed by a square tube to reduce the weight and to increase the rigidity. Hot-dip galvanization, stainless processing, or the like is applied to the support post 23*b* to increase the corrosion resistance.

When the strength of the rectangular-solid support post 23*b* is insufficient, the support post 23*b* may be reinforced by diagonal plate materials or bars in the square tube, or the support post 23*b* may be formed by a prism, although not shown.

Next, the lower plate 21*b* and the upper plate 22*b* according to the present second embodiment are formed by combining four angle steels 25 of the same type in a frame shape. More specifically, the angle steels 25 are disposed in a substantially rectangular frame shape to surround four upper side surfaces and four lower side surfaces of the rectangular-solid support post 23*b* and are fixed by bolts, nuts, or the like as shown in FIG. 7.

Each of the angle steels 25 is provided with one pile hole 24 for inserting one driving pile 3. Four angle steels 25 constituting the lower plate 21*b* and four angle steels 25 constituting the upper plate 22*b* are arranged to be vertically symmetrical as shown in FIGS. 5 to 7. The pile holes 24 of the lower plate 21*b* and the upper plate 22*b* are shifted in the vertical direction, and the driving piles 3 penetrate in a substantially radial pattern.

A placing plate 26 provided with a plurality of bolts are fixed on top of the upper plate 22*b* according to the present second embodiment, and the structural object O is connected on top of the pile foundation body 2*b*.

According to the pile foundation 1*b* of the present second embodiment, the following effects can be obtained in addition to the effects of the pile foundation 1*a* of the first embodiment. The lower plate 21*b* and the upper plate 22*b* can be easily formed by combining the angle steels 25 of the same type. The support post 23*b* according to the present second embodiment is disposed at the center of the pile foundation body 2*b*, and the support post 23*b* can be thick, which is advantageous in increasing the strength. Furthermore, the types of components are reduced, and the assembly is easy. Therefore, the manufacturing cost can be reduced.

The pile foundation according to the prevent invention is not limited to the embodiments, and changes can be appropriately made.

For example, although not shown, the length of the support posts can be adjustable to allow adjusting the tilt angles of the driving piles 3.

REFERENCE SIGNS LIST

1*a*, 1*b* pile foundations
2*a*, 2*b* pile foundation bodies
3 driving pile
4 frost heaving prevention pyramid
5 sedimentation suppression plate
21*a*, 21*b* lower plates
22*a*, 22*b* upper plates
23*a*, 23*b* support posts
24 pile hole
25 angle steel
26 placing plate
O structural object
F ground surface

The invention claimed is:

1. A pile foundation supported on a ground surface for placing a structural object on top, the pile foundation comprising:

a plurality of driving piles: and a pile foundation body supported on the ground surface by the plurality of driving piles, the pile foundation body comprising:

a lower plate disposed on a bottom side;

an upper plate formed in a same shape as the lower plate and disposed on a top side of the lower plate to be vertically symmetrical; and a support post that supports the lower plate and the upper plate substantially parallel at a predetermined interval, wherein the support post of the pile foundation body is configured with a plurality of support bars that perpendicularly extend from the lower plate to the upper plate in order to maintain the predetermined interval, the lower plate and the upper plate comprise a plurality of pile holes through which the driving piles penetrate downward in a substantially radial pattern, the plurality of pile holes formed in a same shape at vertically symmetrical positions of the lower plate and the upper plate.

2. The pile foundation according to claim 1, wherein the pile foundation body further comprises a sedimentation suppression plate formed with a greater dimension to the outside than the lower plate, the sedimentation suppression plate provided on the lower plate.

3. The pile foundation according to claim 2, wherein the support bars support outer edges between the upper plate and the lower plate.

4. The pile foundation according to claim 1, wherein the support bars are arranged along outer edges of the upper plate and the lower plate.

5. The pile foundation according to claim 1, wherein all of the support bars are in a columnar shape.

6. A pile foundation installation construction method, comprising:

placing the pile foundation body of claim 1 on the ground surface, inserting the plurality of driving piles of claim 1 into the pile holes of the pile foundation body from the upper plate to the lower plate in the pile foundation body to drive the plurality of driving piles into a ground in a substantially radial pattern to install the pile foundation.

7. A pile foundation supported on a ground surface by a plurality of driving piles, for placing a structural object on top, the pile foundation comprising a pile foundation body comprising:

a lower plate disposed on a bottom side;

an upper plate disposed on a top side; and a support post that supports the lower plate and the upper plate substantially parallel at a predetermined interval, wherein the lower plate and the upper plate are provided with a plurality of pile holes through which the driving piles penetrate downward in a substantially radial pattern, and the pile foundation body comprises a thermally insulated pyramid-shaped frost heaving prevention pyramid on a bottom surface of the lower plate, an apex of the frost heaving prevention pyramid facing downward.

8. The pile foundation according to claim 7, wherein the frost heaving prevention pyramid is formed in a polygonal pyramid shape, and the pile hole is formed on each side surface of the frost heaving prevention pyramid.

9. The pile foundation according to claim 7, wherein the support post of the pile foundation body is configured with a plurality of support bars, and the support bars support outer edges between the upper plate and the lower plate.

10. The pile foundation according to claim 7, wherein the support post of the pile foundation body is formed in a single structure, the support post is entirely arranged between the upper plate and the lower plate, and the support post is positioned at a center of the lower plate.

11. The pile foundation according to claim 7, wherein the support post of the pile foundation body is configured with a plurality of support bars, and all of the support bars are in a columnar shape.

12. A pile foundation installation construction method, comprising:

placing the pile foundation body of claim 7 on the ground surface, inserting the plurality of driving piles of claim 7 into the pile holes of the pile foundation body from the upper plate to the lower plate in the pile foundation body to drive the plurality of driving piles into a ground in a substantially radial pattern to install the pile foundation.

13. A pile foundation supported on a ground surface by a plurality of driving piles, for placing a structural object on top, the pile foundation comprising a pile foundation body comprising:

a lower plate disposed on a bottom side;

an upper plate disposed on a top side; and a support post that supports the lower plate and the upper plate substantially parallel at a predetermined interval, wherein the lower plate and the upper plate are provided with a plurality of pile holes through which the driving piles penetrate downward in a substantially radial pattern, the support post of the pile foundation body is formed in a single structure and disposed at a center, and four angle steels of a same type are used for each of the lower plate and the upper plate to surround and fix four upper side surfaces and four lower side surfaces of the rectangular-solid support post to form a substantially rectangular frame shape.

14. The pile foundation according to claim 13, wherein the support post of the pile foundation body is formed in a rectangular solid shape.

15. A pile foundation installation construction method, comprising:

placing the pile foundation body of claim 13 on the ground surface, inserting the plurality of driving piles of claim 13 into the pile holes of the pile foundation body from the upper plate to the lower plate in the pile foundation body to drive the plurality of driving piles into a ground in a substantially radial pattern to install the pile foundation.

* * * * *